US011326369B2

(12) United States Patent
Ortolan

(10) Patent No.: US 11,326,369 B2
(45) Date of Patent: May 10, 2022

(54) KEY

(71) Applicant: SILCA S.P.A., Vittorio Veneto (IT)

(72) Inventor: Francesco Ortolan, Vittorio Veneto (IT)

( * ) Notice: Subject to any disclaimer, the term of this patent is extended or adjusted under 35 U.S.C. 154(b) by 130 days.

(21) Appl. No.: 16/760,156

(22) PCT Filed: Nov. 13, 2018

(86) PCT No.: PCT/IB2018/058900
§ 371 (c)(1),
(2) Date: Apr. 29, 2020

(87) PCT Pub. No.: WO2019/092676
PCT Pub. Date: May 16, 2019

(65) Prior Publication Data

US 2020/0270902 A1 Aug. 27, 2020

(30) Foreign Application Priority Data

Nov. 13, 2017 (IT) ..... 102017000129359

(51) Int. Cl.
*E05B 19/04* (2006.01)
*E05B 19/24* (2006.01)

(52) U.S. Cl.
CPC ..... *E05B 19/04* (2013.01); *E05B 19/24* (2013.01)

(58) Field of Classification Search
CPC ..... E05B 19/00; E05B 19/04; E05B 19/24
See application file for complete search history.

(56) References Cited

U.S. PATENT DOCUMENTS 1,032,930 A * 7/1912 Moseley ..... E05B 19/24 40/330
1,322,815 A * 11/1919 Patterson ..... E05B 19/24 40/330
2,349,745 A * 5/1944 Claremont ..... E05B 19/24 40/330
2,533,006 A * 12/1950 Goldsmith ..... E05B 19/24 40/330
3,324,586 A 6/1967 Mitchell
4,349,975 A * 9/1982 Chubb ..... E05B 19/24 40/330
4,417,410 A * 11/1983 Freedom ..... E05B 19/24 40/330

(Continued)

FOREIGN PATENT DOCUMENTS

DE 9211899 11/1992
EP 1057952 12/2000

(Continued)

*Primary Examiner* — Christopher J Boswell
(74) *Attorney, Agent, or Firm* — Themis Law

(57) ABSTRACT

A key includes a key-shaped supporting structure, made of a metal material, which includes a stem and a head having an opening therethrough, the opening being entirely laterally delimited by inner side walls extending from one face of the head to the other; and an insert, made of a polymeric material, which includes an identification system and which is removably inserted into the opening of the head, the insert having at least one section protruding from the inner side walls of the opening and laterally projecting with respect to the opening, thus abutting against a part of the head portion provided about the opening.

17 Claims, 5 Drawing Sheets

(56) References Cited

U.S. PATENT DOCUMENTS

Figure 1:
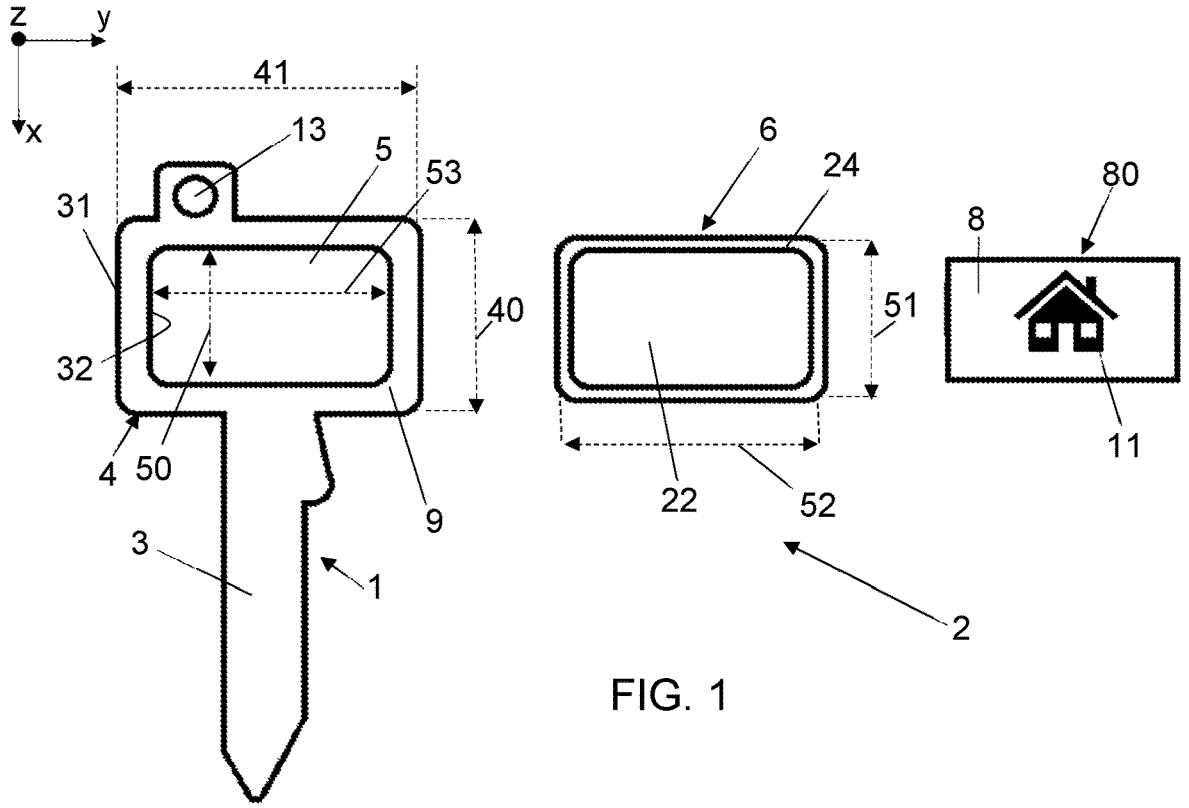

| | | | | |
|---|---|---|---|---|
| 5,113,602 | A * | 5/1992 | Levine | E05B 19/24 40/330 |
| 6,094,954 | A * | 8/2000 | Carmen | E05B 19/24 70/460 |
| 6,308,542 | B1 * | 10/2001 | Bolton | E05B 19/04 70/460 |
| 6,604,308 | B1 * | 8/2003 | Robles | E05B 19/24 70/460 |
| 6,951,122 | B1 * | 10/2005 | Jheng | E05B 19/04 70/460 |
| 7,380,428 | B2 * | 6/2008 | Morehart | E05B 19/04 70/408 |

FOREIGN PATENT DOCUMENTS

| | | |
|---|---|---|
| EP | 1338732 | 8/2003 |
| ES | 267062 | 7/1983 |

* cited by examiner

KEY

The present invention relates to an improved key.

Currently, various solutions to match the keys to the corresponding intended uses are provided, and this in order to immediately identify the key which is provided, for example, to open the house door compared to that provided instead to open the gate, rather than the bike lock.

A first, almost crafted solution includes applying, at the solid portion of the head of a conventional metal key, an adhesive label in which the corresponding intended use of the key itself is written. Such a solution is not completely satisfactory since, following the use of the key or the unavoidable contact with other keys included in the bunch, the associated label tends to deteriorate easily or be removed from the key itself.

Another solution consists in using keys entirely or partially made with a particular color or provided with a colored cap applied at the head of the key itself, and this so as to allow the user to match such a color to a particular intended use. Such a solution is also not completely satisfactory, since the association of the key with a determined color requires the user/operator of the key to know and/or remember that such a determined intended use corresponds to that determined color.

In order to overcome this drawback, a solution has already been suggested, in which the head of the key is covered, entirely or mostly, by a suitable cover or cap, made of colored plastic or rubber, which, at the front, is provided with an opening. In particular, firstly, in such a solution, a label with a writing identifying the intended use is applied on the head of the key and, then, a rubber cap is inserted about the head, thus holding the label in position so that the writing of the latter is visible through the front opening of the cap. In particular, the presence of the cap, which has a certain thickness, defines a protection about the writing of the label while reducing the possibility that the latter deteriorates or detaches from the key with which it is associated.

Such a solution is also not completely satisfactory, since, in addition to increasing the bulkiness of the key, as the protection cap is almost thick, it does not provide an adequate protection of the label; in particular, the fact that the cap is frontally open, at the written and visible part of the label, does not reduce or eliminate the possibility that such a part may be damaged, for example, due to scratches originating from the rubbing against other keys of the bunch.

In this regard, another known solution consists in associating the head of the key with a cap made of plastic or other material (for example leather) in which the writing indicating the intended use of the key is directly printed/defined on the cap itself. Such a solution is also not completely satisfactory, since it is particularly expensive to be carried out, as it requires the use of means adapted to directly write on said cap, and furthermore, once the writing has been defined, it may not be modified or readapted in any manner, if not by replacing the entire cap.

Another solution consists in associating each key with a corresponding pendant containing a paper card in which the user/operator of the key writes the corresponding intended use. In particular, such a pendant is associated with the key as if it were a keyring, i.e., by means of a metal ring in the shape of a spring, which is inserted into the circular hole provided in the head of the key itself.

Such a solution is also not completely satisfactory, since, in addition to considerably increasing the bulkiness of the key itself, it is more expensive to be implemented, since it requires to purchase, usually at a time following the purchase of the key, an additional piece (i.e., the pendant) which is substantially independent of the key itself. Furthermore, also the operation of associating the pendant with the key is almost laborious to be carried out.

EP1057952 describes a key with a stem and a head, having an essentially laminar extension (i.e., with two dimensions much greater than the third one) and having a through opening which passes through the two opposite faces of the head itself. In particular, in such a solution, on the walls laterally delimiting the through opening, suitable machining operations are carried out, so as to define grooves, and/or further projecting elements (for example tabs, attachments, bars, rails) are fastened, so as to allow the insertion and engagement of a transparent insert capable of containing an identifying label. Furthermore, the insert has a thickness equal to or smaller than that of the head of the key and, once inserted into the through opening defined in said head, said insert is completely accommodated in said opening, without extending out of the faces of said head and thus avoiding increasing the volume of the head itself. Furthermore, in EP1057952 the head provided with the through opening is obtained by die-casting.

This solution is not fully satisfactory since—being made by die-casting and inevitably requiring the use of complex molds or subsequent machining to make grooves/recesses or to fasten additional projecting elements (tabs, rails, etc.)—it is almost complicated and expensive to be constructed. Furthermore, following the use of such a key, the insert which is inserted into the head of the key and which contains the identifying label may be easily damaged, in particular, it may be scratched, etched or deformed on a surface level, thus making the reading of said label more complicated by the user/owner of said key.

U.S. Pat. No. 3,324,586 describes a key with a stem and a head, which has an essentially laminar extension and has a through opening which passes through the two opposite faces of the head itself. In particular, in such a solution, the walls laterally delimiting the through opening are grooved as a "V" or are cut/tapered at one end so as to allow the insertion and engagement of a transparent and protective body for covering a label inside said opening. In such a solution, the transparent and protective body also has a thickness equal to or smaller than that of the head of the key, as it is configured to be completely positioned/inserted into the through opening without extending out of the faces of said head, thus avoiding increasing the volume of the head itself.

This solution is not fully satisfactory since the insertion of the body into the V-shaped grooves of the side walls of the through opening does not guarantee a suitable and stable constraint of the body itself with the head of the key, thus risking that the body may be easily removed, especially in conditions in which the key is repeatedly put in contact with other objects or when using the key itself in a lock. Furthermore, also in this case, following the use of such a key, the body—which is inserted into the head of the key and which contains the identifying label—may be easily damaged, in particular, it may be scratched, or etched on a surface level, thus making the reading of said label more complicated by the user/owner of said key.

U.S. Pat. No. 6,094,954 describes a key with a stem and a head, which has an essentially laminar extension and has a first through opening which passes through the two opposite faces of the head and, furthermore, has a second side opening which is entirely obtained in the thickness of said head and which puts in communication the first through opening with the outer walls of said head. Through this second side opening a transparent body (containing an identifying label) is inserted into said first through opening, so that said label is then visible through said first opening. More in detail, the transparent body has a thickness smaller than that of the head and, furthermore, is shaped so that, once inserted, it is stably blocked within the first through opening and the second side opening.

It is easy to see how this solution is not fully satisfactory since, requiring two openings be made on the head—and in particular a side opening be made, extending perpendicularly with respect to the thickness of the head—it is almost complicated and expensive to be constructed.

It is the object of the present invention to suggest an improved key which overcomes the aforesaid drawbacks present in the conventional solutions.

It is another object of the invention to suggest an improved key which allows to avoid or, in any case, to reduce the possibility of a damage thereof, in particular at the surface level.

It is another object of the invention to suggest an improved key which remains compact and resistant, even during and following the use thereof.

It is another object of the invention to suggest an improved key which does not require openings to be made, extending perpendicularly with respect to the thickness of the head and, as such, are particularly complicated to be obtained.

It is another object of the invention to suggest an improved key which allows the user/operator thereof an easy and quick identification of the intended use thereof.

It is another object of the invention to suggest an improved key which allows the user/operator to integrate inside the key itself an indication of the intended use thereof or other useful information.

It is another object of the invention to suggest an improved key which is light and not bulky.

It is another object of the invention to suggest an improved key which, in order to identify the intended use thereof, does not require pendants, keyrings or additional elements to be associated with the key itself.

It is another object of the invention to suggest an improved key on which an identifying label may be applied, which may not be easily loosed or destroyed.

It is another object of the invention to suggest an improved key which allows the application of an indication of the intended use thereof which may be easily removed.

It is another object of the invention to suggest an improved key which allows the application of an indication of the intended use thereof which may be stably associated with the key.

It is another object of the invention to suggest an improved key which includes an identifying label and which is more solid and wear-resistant with respect to conventional keys.

It is another object of the invention to suggest an improved key which is highly customizable.

It is another object of the invention to suggest an improved key which may be produced in series and in a quick and efficient manner.

It is another object of the invention to suggest an improved key which allows to obtain a pleasant overall aesthetic effect and which provides the sensation of being in front of a high-quality product, both on an aesthetic and functional level.

It is another object of the invention to provide an improved key which has both functional and aesthetic high standards, while being affordable, thus allowing the possibility of a large-scale distribution thereof.

It is another object of the invention to suggest an improved key which is both an improvement and/or an alternative to conventional ones.

It is another object of the invention to suggest an improved key with an alternative characterization, both in functional and implementation terms, with respect to the conventional ones.

It is another object of the invention to suggest an improved key which may be obtained in an easy, quick and cost-effective manner.

All these and other objects which will become apparent from the following description are achieved, according to the invention, by a key having the features set forth in claim 1.

Figure 2:
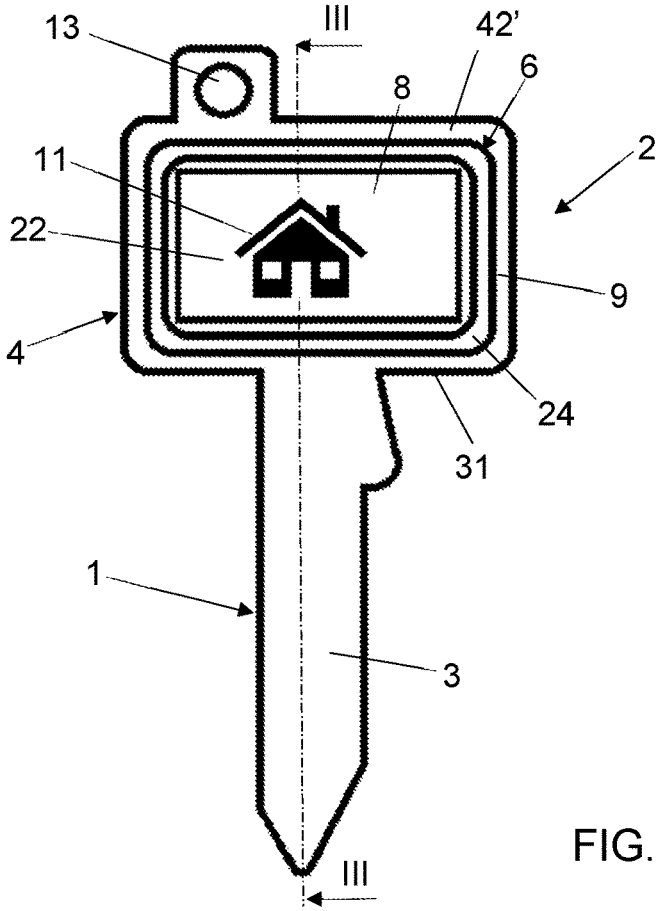
Figure 3:
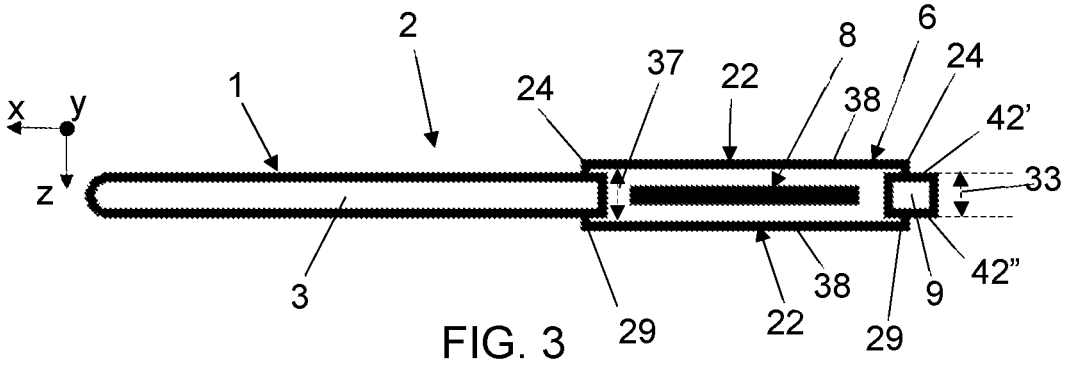
Figure 4:
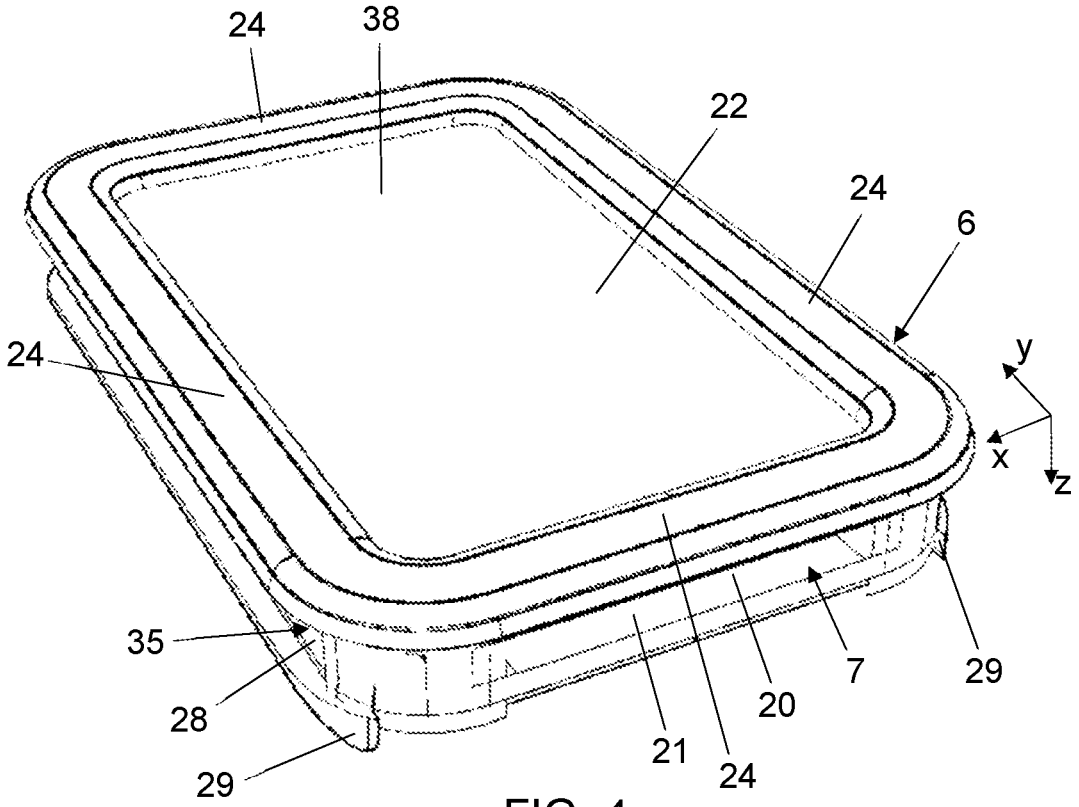
Figure 5:
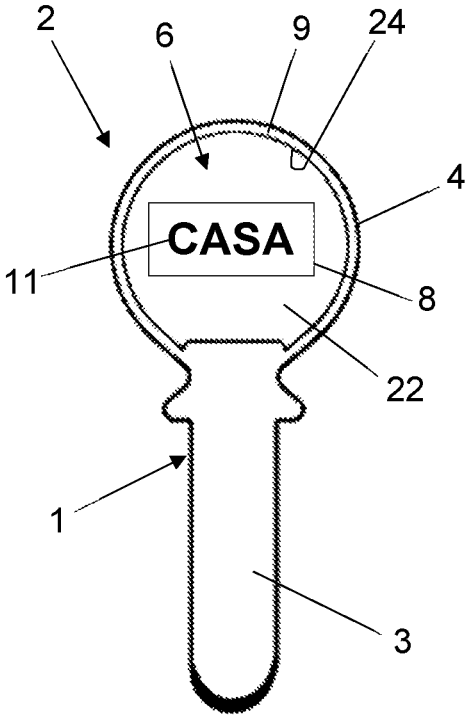
Figure 6:
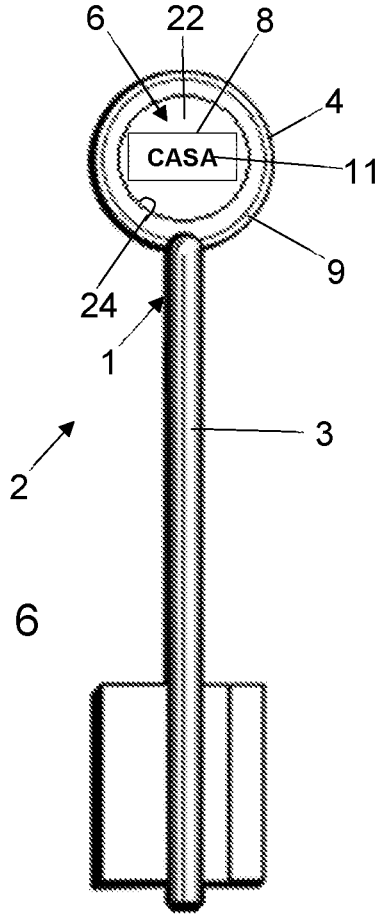
Figure 7:
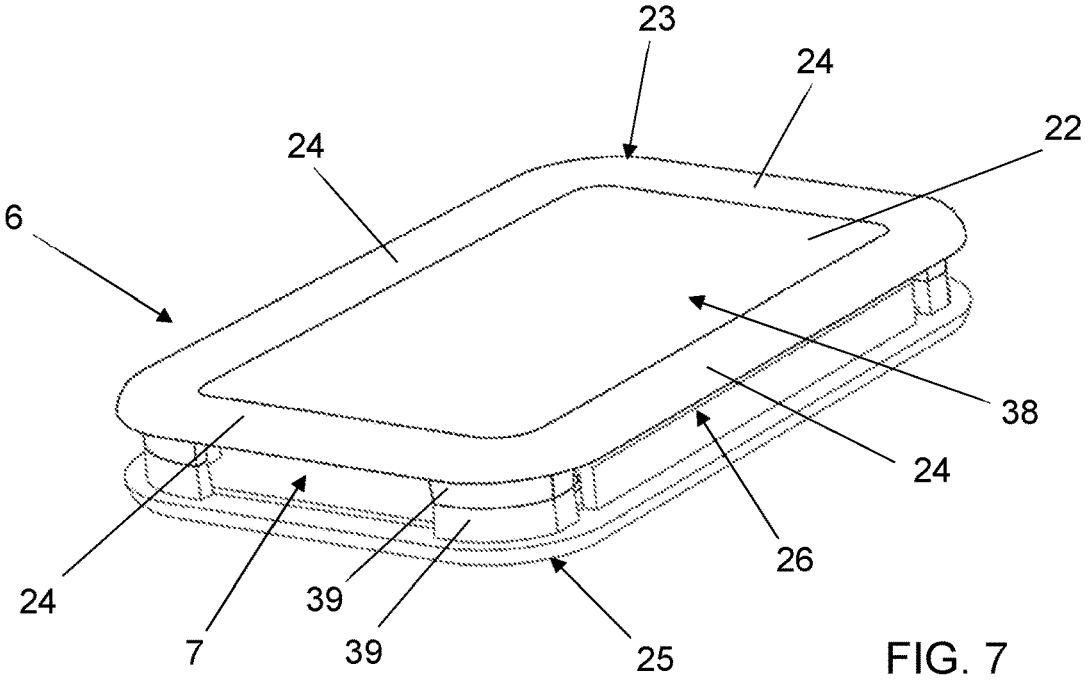
Figure 8:
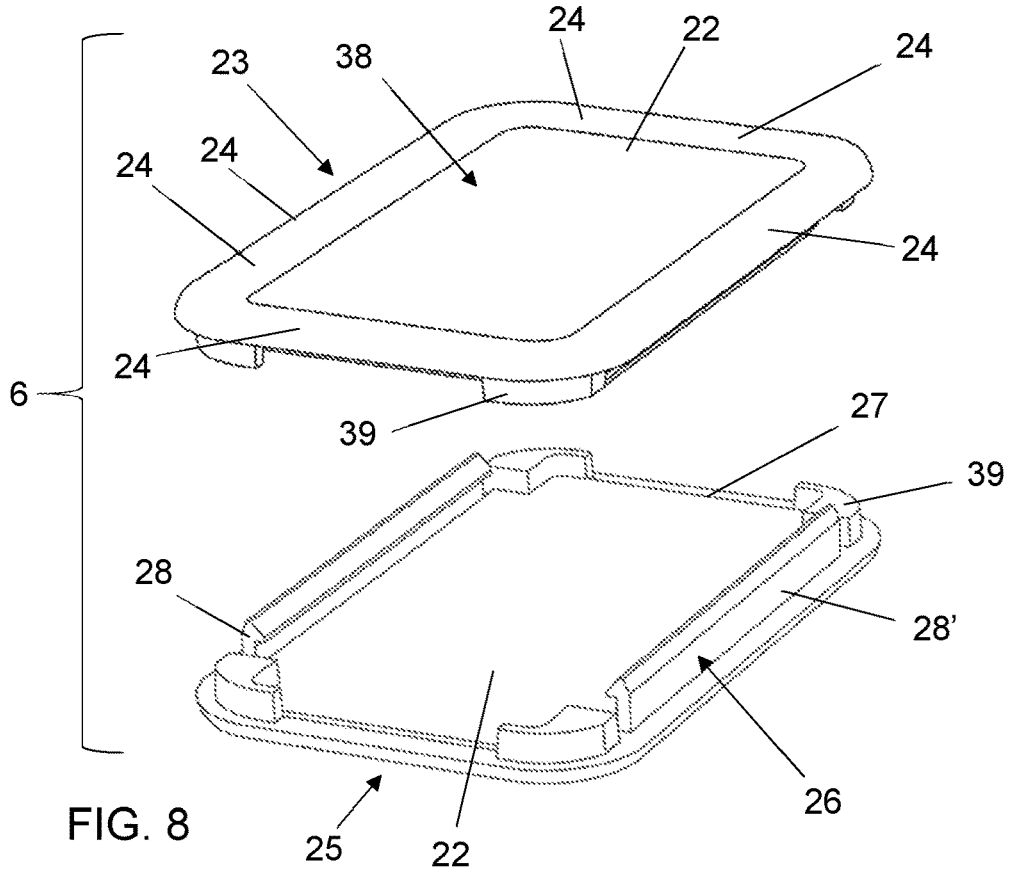
Figure 9:
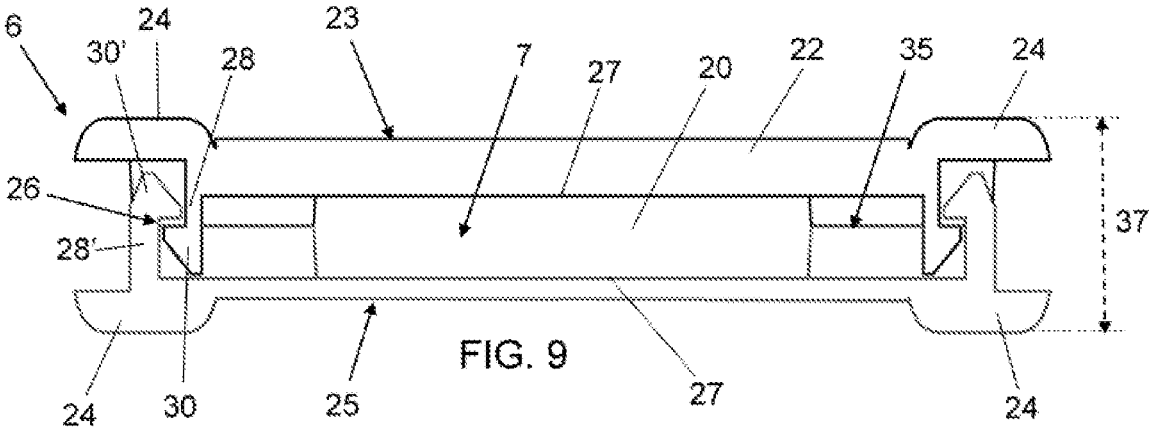

The present invention is further clarified hereafter in a preferred embodiment thereof, given merely by way of explanation and not by way of limitation, with reference to the accompanying drawing, in which:

FIG. 1 shows an exploded perspective view of the components of the improved key according to the invention, FIG. 2 shows a plan view thereof in an assembled configuration, FIG. 3 shows it according to section III-III of FIG. 2, FIG. 4 shows a perspective view of a first embodiment of the insert of the key in accordance with the invention, FIGS. 5 and 6 show the key in accordance with the invention in different embodiments and in the same view and configuration of FIG. 2, FIG. 7 shows a perspective view of a different embodiment of the insert of FIG. 4, FIG. 8 shows an exploded perspective view of the insert of FIG. 7, FIG. 9 shows, according to a vertical section, the insert of FIG. 7

Figure 10:
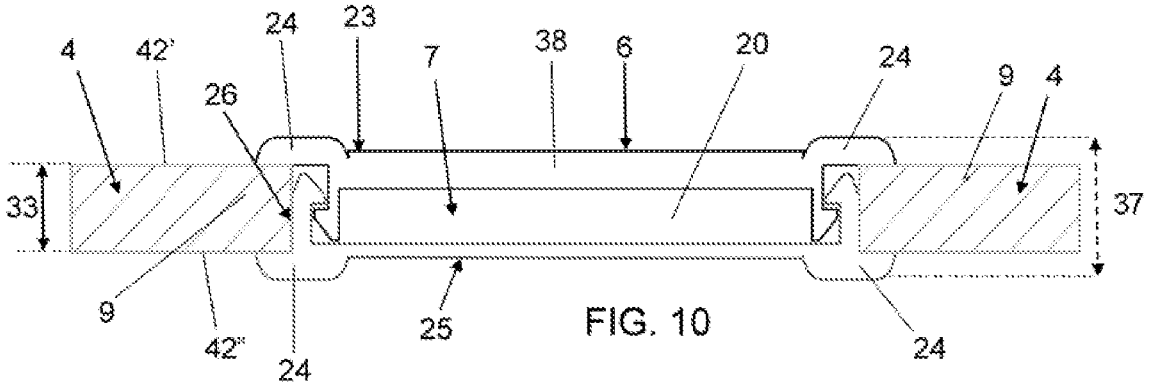
Figure 11:
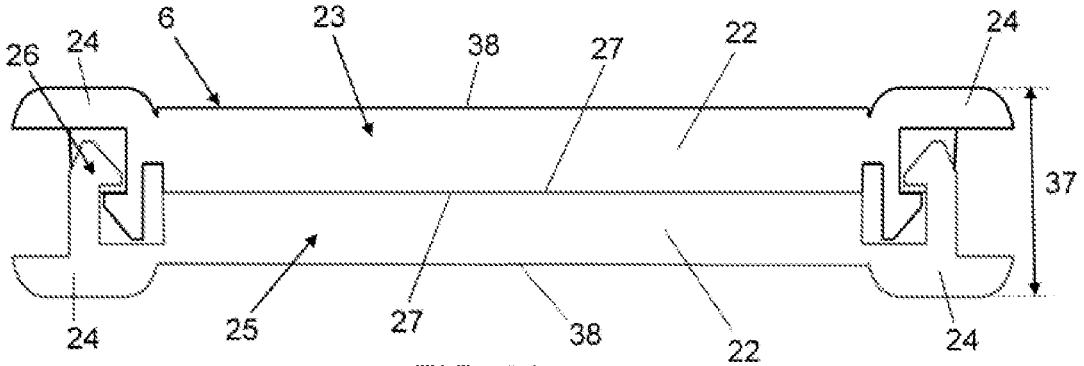

FIG. 10 shows, according to a vertical section, the insert of FIG. 7 engaged and inserted into the head of the key-shaped structure, and FIG. 11 shows, according to a vertical section, a variant of the embodiment of the insert of FIG. 7.

As it may be seen from the Figures, the improved key 2 according to the invention comprises a supporting structure 1, preferably made of metal material, which substantially has the shape of a key. In particular, the structure 1 may substantially assume all the configurations of the conventional types of keys and, more in detail, it may be shaped, for example, as a side cut key (see FIG. 2), as a punched key (see FIG. 5) or as a double-bitted key (see FIG. 6).

Conveniently, the key-shaped structure 1 may be made of any metal material or alloys thereof, preferably of steel, natural or anodized aluminum, nickel-plated and non-nickel-plated brass, nickel silver.

Conveniently, the stem 3 of the structure 1 is shaped to be inserted into a lock and actuate it.

Irrespective of the configuration of the stem 3 thereof, the key-shaped structure 1 has a head 4, substantially corresponding to the portion intended to be gripped by the user. Conveniently, the structure 1 is made as a single piece in which the head 4 is connected to the stem 3.

The head 4 of the key has a laminar shape, in the sense that the extension of the thickness 33 thereof (i.e., along the axis Z) is much smaller than that of the other two dimensions (length 40 along the axis X and width 41 along the axis Y).

Conveniently, the plan shape of the head 4 may be of any type, for example, it may be round, rectangular, polygonal, with rounded or sharp corners.

The head 4 internally comprises a through opening 5 in which an insert 6, comprising an identification system 80, is removably inserted and positioned. Advantageously, the through opening 5 affects most of the head 4 of the structure 1.

Conveniently, the opening 5 of the head 4 is obtained by shearing (or punching) a metal sheet. Preferably, the opening 5 of the head 4 is obtained by shearing (or punching) a metal sheet, without the need for further machining.

Advantageously, the stem 3 and the head 4 with the through opening 5 are all obtained by shearing (or punching) a metal sheet, preferably in a single operation.

In particular, the head 4 has two faces 42' and 42", which are opposite and substantially parallel to each other and in which the respective outer edges are connected to each other by outer side walls 31. Conveniently, the outer side walls 31 define the outer shape of the head 4. Conveniently, the thickness 33 of the head 4 of the supporting structure 1 corresponds to the height of the outer side walls 31.

Conveniently, the through opening 5 affects both opposite faces 42', 42" of the head 4 and extends through the thickness 33 of the head 4 from one face to the other.

In particular, the through opening 5 is entirely laterally defined/delimited by inner walls 32 which extend from one face 42' to the other face 42" of the head 4 of the supporting structure 1.

Conveniently, the inner side walls 32 of said through opening 5 connect the opposite faces 42' and 42" of the head 4 to each other.

Conveniently, the inner side walls 32 delimit the through opening 5 so that this is entirely, laterally closed. In other words, the inner side walls 32 define a closed side profile/periphery laterally surrounding/delimiting the through opening 5.

Conveniently, the portion 9 of head 4 surrounding the through opening 5 is defined between the inner side walls 32 and the outer side walls 31 of said head. Advantageously, the portion 9 is solid, i.e., it is devoid of further openings or perforations, if not that provided for the insertion of the ring of a keyring or the like.

Conveniently, the through opening 5 has a plan shape of a polygon, for example of a rectangle, or of a closed curve, for example of a circle or ellipse. Advantageously, as shown in FIG. 1, the through opening 5 has a rectangular shape and is delimited by four inner side walls 32 and, more in detail, by two longer parallel walls and by two shorter parallel walls.

Conveniently, the inner side walls 32, delimiting the through opening 5, are separated from the outer side walls 31 of the head 4 by means of corresponding solid portions 9 of the head itself. Conveniently, between the outer walls 31 and the inner side walls 32 of the through opening 5, no opening, hole or slot is provided for the connection between said walls. Conveniently, in the head 4 only through openings are obtained (and, in particular, the through opening 5 and, at most, also at least one conventional through hole 14 for the ring of the keyring) which cross the head itself from one face 42' to the other 42" along the thickness 33 and, therefore, no opening is perpendicularly extending with respect to said thickness.

Advantageously, the inner walls 32, laterally delimiting the through opening 5, are all substantially flat in the extension thereof along the thickness 33 of the head 4, i.e., they are devoid of projecting sections or hollow sections along said thickness (i.e., along the axis Z). Preferably, the inner walls 32, laterally delimiting the through opening 5, are all substantially rectilinear along the thickness 33 of the head 4.

Preferably, the inner walls 32, laterally delimiting the through opening 5, are all entirely and substantially perpendicular to the faces 42' and 42" of the head 4.

Preferably, the inner side walls 32, delimiting the through opening 5, have continuous surfaces, i.e., devoid of recesses or projections. Preferably, the inner walls 32, laterally delimiting the through opening 5, are all substantially smooth.

Preferably, the inner walls 32, laterally delimiting the through opening 5, are devoid of projecting sections extending from said walls into the opening itself. Preferably, the inner walls 32, laterally delimiting the through opening 5, are devoid of grooves or recesses obtained in said walls.

Advantageously, the insert 6 is provided with an identification system 80 comprising a writing 11, a symbol and/or an image which is directly obtained on the insert 6.

Advantageously, the insert 6 removably accommodates an identification system 80 therein, comprising a laminar element 8 (for example a label or card) having on one or on both the faces thereof a writing 11, a symbol and/or an image. In particular, the insert 6 is internally provided with a seat 7 for protectedly accommodating the laminar element 8, preferably a card or a label provided with a writing 11, a symbol or an image. Conveniently, the laminar element 8 may be configured so that the writing 11, the symbol or the image may be applied on only one or on both faces thereof. Preferably, a writing is applied on the laminar element 8 indicating the corresponding intended use of the key 2. Advantageously, on one face of the laminar element 8—preferably on the face opposite to that on which the writing 11, corresponding to the intended use of the key 2, is applied—a further writing and/or image is applied, such as, for example, the name, address and/or logo identifying the key duplicating center.

Conveniently, as already said, the head 4 may also comprise, conventionally, a hole 13 preferably of a circular shape for the insertion of the ring of a keyring or the like.

Advantageously, the insert 6 may be inserted by interlocking into the opening 5 to allow the easy interchangeability of said insert and thus obtain a high possibility of customizing the key 2. Conveniently, to this end, the insert 6 has—at least partially—a shape and dimensions substantially corresponding to those of the opening 5.

Advantageously, the insert 6 has a substantially slab-like shape, i.e., the thickness 37 thereof is much smaller than the other two dimensions. Conveniently, the insert 5 comprises two walls 22 which face each other, are spaced apart, are substantially parallel and are configured to completely cover the respective faces of the laminar element 8.

Advantageously, the insert 6 may be made as a single body, i.e., as a single piece (see first embodiment shown in FIGS. 1-4), or it may comprise two bodies (half-shells) 23, 25 (see second embodiment shown in FIGS. 7-11), i.e., as two separate pieces which are stably coupled to each other, preferably in a removable manner.

Conveniently, at least one of the two half-shells 23, 25 comprises hooking means 26 to allow the junction of the two half-shells 23, 25 so as to define, as a whole, the insert 6. Preferably, the hooking means 26 are present on both half-shells 23, 25 to allow the mutual hooking thereof. Conveniently, the two half-shells 23, 25 mutually hook each other so as to close as a "sandwich" about the through opening 5 of the head 4. More in detail, a first half-shell 23 is positioned on the first face 42' at the through opening 5 while the other half-shell 25 is positioned on the other face 42" at the through opening 5 and then by pushing them towards each other, the activation of the hooking means 26 is caused and therefore the mutual junction of the two half-shells 23, 25.

Advantageously, the hooking means 26 may comprise constraining members defined in the first shell 23 and corresponding constraining counter-members defined in the other shell 25. Preferably, the constraining members and the constraining counter-members respectively comprise elastically yielding tabs 28 and 28', provided with respective teeth 30 and 30', adapted to mutually engage with each other. Preferably, the hooking means 26 are provided at two sides, parallel to each other, of the two half-shells 23, 25. Preferably, the hooking means are provided along one part or along the entire periphery of the half-shells 23, 25.

Alternatively, in a variant not shown, the hooking means 26 may comprise shaped and counter-shaped areas placed on both half-shells 23, 25, and adapted to interact and/or interlock with each other to thus define the insert 4.

Conveniently, the insert 6 comprises a seat 7 therein, adapted to contain the laminar element 8. Advantageously, the seat 7 is defined by a laminar extension cavity 20 (pocket) of slightly greater dimensions than the laminar element 8 so as to allow the insertion and accommodation of said element therein. Conveniently, the cavity 20 is defined between the inner faces 27 of the walls 22 of said insert 6, walls which are mutually parallel, facing each other and spaced apart.

Advantageously, the cavity 20 of the seat 7 may be reached by means of a side passage 21 of dimensions adapted to allow the insertion and the sliding of the laminar element 8 into the cavity itself.

Conveniently, in the embodiment in which the insert 6 comprises two half-shells 23 and 25, the laminar extension cavity 20 (pocket) is defined following the coupling of said two half-shells.

Preferably, in such an embodiment, when the two half-shells are coupled, the cavity 20 may be closed and completely isolated from the outside. Conveniently, to this end, on the inner faces 27 of the walls 22 of the two half-shells 23 and 25 side borders 39 are provided, which are in contact when the two half-shells are mutually hooked.

Conveniently, as shown in FIGS. 9 and 10, the cavity 20 is defined between the inner faces 27, facing each other and spaced apart, of the two half-shells 23, 25.

Advantageously, as shown in the variant of FIG. 11, the two half-shells 23, 25 may be configured so that, once they are mutually joined by means of the hooking means 26, they define a solid area (i.e., without the cavity 20) in which the respective inner faces 27 of the walls 22 are reciprocally in contact or extremely close to each other.

Conveniently, when the laminar element 8 is inserted into the seat 7, the two opposite faces of the element itself are protected (i.e., separated from the outside) by the corresponding walls 22 of the insert 6 and, advantageously, this allows to obtain a greater duration of the laminar element 8, and in particular of the writing 11 or the image applied.

The insert 6 is configured so that at least one part of one or of both faces of the laminar element 8 is visible from the outside. Conveniently, to this end, the insert 6 is at least partially, preferably as a whole, made of a substantially transparent material, and this so as to allow the user to see from the outside, through the insert 6, the faces of the laminar element 8, which is accommodated in the seat 7 and on which the writing 11 or the image is applied.

Conveniently, the insert 6 is made of polymeric material, preferably of plastic, and may have various colors (both fluorescent and natural).

Conveniently, the insert 6 may be made of colored transparent material to improve the visibility of a writing or image present on the laminar element 8.

Conveniently, furthermore, the insert 6 may be customized with appropriate, both superficial and inner graphics, images or decorations.

Advantageously, the writing 11, the symbol or the image may be directly obtained on the insert 6, preferably it may be obtained by stamping or engraving or etching the outer face 38 and/or the inner face 27 of said insert 6. Conveniently, in this case, the insert 6 may be made of an opaque material.

The insert 6 comprises, at one or both the outer faces 38 thereof, at least one section 24 protruding from the inner walls 32 of the through opening 5 and laterally projecting with respect to said through opening 5 thus abutting against a part of the portion 9, provided about said through opening, of said head 4.

In particular, the insert 6, at one or both the outer faces 38, has at least one section 24 which laterally projects, i.e., a section which—when the insert is inserted/positioned into the through opening 5—protrudes along the axis Z from said through opening 5 and extends in length along the axis X and/or in width along the axis Y.

Conveniently, at the projecting section 24 thereof, the insert 6 has a length 50 (i.e., an extension along the axis X) which is greater than the corresponding length extension 51 of the through opening 5. Conveniently, at the projecting section 24 thereof, the insert 6 has a width 52 (i.e., an extension along the axis Y) which is greater than the corresponding width extension 53 of the through opening 5.

Conveniently, the projecting portion 24 of the insert 6 is conveniently thickened, so as to guarantee better impact resistance.

Conveniently, at said projecting portion 24, the insert 6 has a thickness 37 which is greater than the thickness 33 of the head 4 of the structure 1 and, in particular, is greater than the thickness that the head 4 has at the through opening 5.

In essence, once the insert 6 has been inserted and accommodated into the through opening 5, a peripheral section 24 thereof projects beyond the thickness of the head 4 and laterally with respect to the through opening 5. This entails that at least one section 24 of the insert 6 projects from the opening 5, both along the axis Z (corresponding to the extension direction of the thickness of the head 4) and along the axis X (corresponding to the extension direction of the stem 3) and/or Y (corresponding to the direction which is perpendicular to the other two, so as to complete the set of three Cartesian axis).

Conveniently, the insert 6 has an inner portion 35 (which is conveniently defined by flanks 28), which is inserted and accommodated into the through opening 5, and said section 24 which laterally projects with respect to said through opening 5.

Advantageously, the projecting section 24 may affect a part of the periphery of the outer face 38 of the insert 6 or all the sides of the outer faces 38 or, preferably, continuously affects the entire periphery/contour of said face (see FIGS. 4, 7 and 8). Therefore, conveniently, the laterally projecting section 24 defines a continuous peripheral flange which abuts against the portion 9 of the head 4 and, in particular, against the entire peripheral extension of the portion 9 surrounding the through opening 5.

Advantageously, this allows to increase the blocking of the insert 6 inside the through opening 5 of the head 4, since the laterally projecting section 24 counteracts the removal of the insert 6 even against a thrust applied at least along one of the two insertion directions (i.e., applied along the axis Z according to one of the two opposite directions thereof).

Advantageously, the projecting portion 24 may affect the outer face 38 of a single wall 22 of the insert 6 or, preferably, affects the outer faces 38 of both walls 22.

In particular, in the embodiment of the insert 6 with the two half-shells 23 and 25, the laterally projecting section 24 is obtained on both the outer faces 38 of the two half-shells and, advantageously, this counteracts the removal of the insert itself, even against a thrust applied along the axis Z for both the directions (opposite to each other) provided for the insertion of the half-shells into the through opening 5.

Advantageously, the insert 6 has, at the central (innermost) area thereof, a thickness which is substantially smaller than the thickness 37 of the peripheral edge thereof in which said projecting section 24 is defined. Preferably, the central area of the insert 6 has a thickness which is substantially equal to or slightly greater than that of the head 4 at the through opening 5.

Advantageously, at least one of the outer faces 38 of the insert 6 has said section 24, which is defined at the peripheral edge of said face, laterally projecting with respect to said through opening 5, thickened and raised with respect to the remaining inner (most central) area of the face 38. This conveniently allows to protect said inner (most central) area of the wall 22—inner area on which a writing/symbol/image is obtained or which faces the area of the laminar element 8 on which the writing 11 or the image is applied—from deformations or scratches, originating from the rubbing against other keys of the bunch, which, if present, may prevent or contrast the visualization of the writing 11 or of the image.

Conveniently, the insert 6 may comprise one or more yielding portions so as to allow the insertion thereof by interlocking into the opening 5. Preferably, in the first embodiment of the insert 6 (see FIG. 4), the latter comprises, along two opposite side walls or along the entire or part of the side periphery thereof, elastically yielding flanks 28 terminating with hooking teeth 29. Conveniently, the insert 6 is inserted into the opening 5 and, in doing so, the flanks 28 are compressed towards the interior by the inner walls delimiting the opening 5 until the teeth 29 hook a first face 42' of the head 4 at the portion 9 surrounding the opening 5. Conveniently, the laterally projecting outer section 24 of the insert 6 abuts against (i.e., rests against) the other face 42" of the head 4 at the portion 9 surrounding the opening 5.

Advantageously, as said, in the embodiment of the insert 6 with the two half-shells 23 and 25 (see FIGS. 7-11), the hooking between the two is directly carried out inside the opening 5. In particular, one of the two half-shells 23 is thus inserted into the opening 5 at a first face 42' of the head, and the second half-shell 25 is inserted into said opening at the other face 42" of the key, while joining the first one by means of the hooking means 26 and thus closing (and covering) said through opening 5 between each other. This mode of application is particularly simple, and allows a quick removal of the insert 6 from the head 4 so as to enable the replacement of the insert itself and/or of the laminar element 8, for example, in case the intended use of the key changes. Furthermore, advantageously, as already said, this embodiment allows a better sealing/blocking of the insert 6 inside the through opening 5.

Conveniently, the presence of the section 24, which is laterally projecting and thickened, causes the overall volume of the key 2 (which is given by the structure 1 with the insert 6 inside the through opening) to be greater than that of the structure 1 alone.

From the foregoing, it is clear that the improved key in accordance with the invention is much more advantageous than the conventional solutions, since:

the user may define/match the intended use of the key by writing directly on one of the two faces of the laminar element, the laminar element, on which the writing or image is applied, indicating the intended use or another information of the key to which it is matched, is protected from the outside while being easily readable and accessible for any possible subsequent changes or additions, it is light and compact, since the dimensions substantially correspond to those of conventional keys, it is economical, since the through opening defined at the head allows to reduce the amount of metal used and, furthermore, it may be simply and easily obtained by shearing/punching; furthermore, the use of a plastic insert to cover/fill said through opening is less expensive than the corresponding amount of metal which would be necessary to make the head without through opening, is easy and quick to be produced; in particular, unlike the current solutions which include plasticizing the head of the key, it does not require the presence of an operator in front of the plasticizing machine during the production of the key itself, is highly and easily customizable; in particular, the insert is simply and easily removable from the head, without the use of accessory tools, so as to allow the replacement with another insert or the accommodation of the laminar element inside the insert itself, the insert on which the writing or image is applied, or in which the laminar element is accommodated with such a writing or image, is stably locked at the head of the key even during the use of the key itself and, in particular, when on the head of said key, which is gripped by the user, a force is applied adapted to cause the rotation of the stem of the key itself inside the lock, the shape of the insert protects the key itself from impacts and avoids deformations and scratches at the area which is intended to be visible/legible, In particular, unlike in the solutions described in EP1057952, U.S. Pat. Nos. 3,324,586 and 6,094,954, in the improved key in accordance with the invention the insert has a section protruding from the through opening and laterally projecting from the latter and, therefore, it does not have a thickness which is entirely and completely smaller than that of the head of the key. Furthermore, unlike in the solution of EP1057952 and U.S. Pat. No. 3,324,586, the blocking of the insert in the opening obtained in the head of the key does not require to construct rails, V-shaped grooves or chamfers on the inner side walls of the through opening of the projections, thus avoiding subsequent machining or the use of more complex die-casting molds. Furthermore, the improved key in accordance with the invention is different from that presented in U.S. Pat. No. 6,094,954, since it does not include the construction, inside the head, of a second side through opening for the insertion of the insert.

The invention claimed is:

1. An improved key comprising:

a key-shaped supporting structure, made of a metal material, comprising a stem and a head, the head being provided with a through opening extending to opposite faces of the head through a thickness of the head, the through opening being entirely laterally delimited by inner side walls extending from a first one of the opposite faces of the head to a second one of the opposite faces; and an insert, made of a polymeric material, comprising an identification system, the insert being removably inserted into the through opening of the head, wherein the insert comprises at least one section protruding outwardly of the through opening and laterally projecting to cover a portion of the head adjacent to the through opening, thus abutting against a part of a portion of the head provided about the through opening, the insert accommodating the identification system removably therein, wherein the insert comprises two separate half-shells coupled to each other, each of the two separate half-shell protruding outwardly of the through opening and laterally to cover a respective portion of the head adjacent to the through opening, wherein at least one of the two half-shells of the insert comprises a hooking member enabling a junction of the two half-shells, thus defining, as a whole, the insert, and wherein the two half-shells are configured so that a cavity configured for accommodating a laminar element is defined following the coupling of the two half-shells and a mutual junction thereof by the hooking member.

2. The improved key according to claim 1, wherein the laminar element has two faces, one or on both faces of the laminar element having a writing, a symbol and/or an image thereon.

3. The improved key according to claim 1, wherein the through opening of the head is obtained by shearing or punching a metal sheet, or wherein the stem and the head with the through opening are all obtained by shearing or punching the metal sheet.

4. The improved key according to claim 1, wherein outer edges of the opposite faces of the head are connected to each other by outer side walls, the opposite faces being further connected to each other by the inner side walls of the through opening, and wherein the inner side walls define a closed side periphery laterally delimiting the through opening.

5. The improved key according to claim 4, wherein the inner side walls, laterally delimiting the through opening, are all flat and solid along an entire extension of the side walls along the through opening through the thickness of the head.

6. The improved key according to claim 4, wherein the inner side walls, laterally delimiting the through opening, are devoid of projecting sections extending from the inner side walls into the opening itself or are devoid of grooves or recesses obtained in the inner side walls.

7. The improved key according to claim 1, wherein the insert is adapted to be inserted in the through opening by interlocking into the through opening.

8. The improved key according to claim 1, wherein the two separate half-shells are configured to mutually hook so as to close about the through opening of the head, a first one of the two separate half-shells being positioned on the first one of the opposite faces of the head at the through opening, and a second one of the two separate half-shells being positioned on the second one of the opposite faces of the head at the through opening.

9. The improved key according to claim 1, wherein the insert has a seat defined therein for protectedly accommodating the laminar element, the insert being configured so that at least one face of the laminar element, when accommodated in the seat, is at least partially visible from the outside.

10. The improved key according to claim 9, wherein the insert comprises the seat defined therein by the cavity having a laminar extension for accommodating the laminar element.

11. The improved key according to claim 10, wherein the cavity is closed and isolated from an outside environment.

12. The improved key according to claim 1, wherein the insert is at least partially made of a substantially transparent material.

13. The improved key according to claim 1, wherein the at least one section, protruding from the inner side walls of the through opening and laterally projecting with respect to the through opening, is provided on both outer faces, opposite to each other, of the insert.

14. The improved key according to claim 1, wherein, at the at least one section protruding from the inner side walls of the through opening and laterally projecting with respect to the through opening, the insert has a thickness which is greater than a corresponding thickness of the head.

15. The improved key according to claim 1, wherein the section, protruding from the inner side walls of the through opening and laterally projecting with respect to the through opening, is thicker than a remainder of the insert.

16. The improved key according to claim 1, wherein the insert comprises:

an inner portion, which is inserted and accommodated into the through opening; and the at least one section protruding from the inner side walls of the through opening and laterally projecting with respect to the through opening.

17. The improved key according to claim 1, wherein the section, protruding from the inner side walls of the through opening and laterally projecting to the through opening, is shaped to surround an entire peripheral edge of an outer face of the insert.

* * * * *